US005312193A

United States Patent [19]

Kringe et al.

[11] Patent Number: 5,312,193

[45] Date of Patent: May 17, 1994

[54] CONTROL DEVICE FOR A MATRIX PRINTER

[75] Inventors: Horst Kringe, Netphen; Reinhold Winter, Wilnsdorf; Martin Crevecoeur, Kreuztal-Ferndorf; Hartmut Korn, Siegen, all of Fed. Rep. of Germany

[73] Assignee: U.S. Philips Corporation, New York, N.Y.

[21] Appl. No.: 18,902

[22] Filed: Feb. 17, 1993

Related U.S. Application Data

[63] Continuation of Ser. No. 549,344, Jul. 6, 1990, abandoned.

[30] Foreign Application Priority Data

Jul. 10, 1989 [DE] Fed. Rep. of Germany ..... 3922616
Mar. 9, 1990 [DE] Fed. Rep. of Germany ..... 4007537

[51] Int. Cl.[5] ..... B41J 02/25

[52] U.S. Cl. ..... 400/121; 400/279; 400/322

[58] Field of Search ..... 400/121, 279, 320, 322

[56] References Cited

U.S. PATENT DOCUMENTS

| | | | |
|---|---|---|---|
| 4,010,835 | 3/1977 | Martin | 400/121 |
| 4,189,246 | 2/1980 | Kane | 400/144.2 |
| 4,389,935 | 6/1983 | Arai | 400/157.3 |
| 4,407,193 | 10/1983 | Hall | 400/157.3 |
| 4,421,431 | 12/1983 | Dorrfub et al. | 400/124 |
| 4,487,515 | 12/1984 | Harris | 400/121 |
| 4,757,462 | 7/1988 | Sato | 400/121 |

*Primary Examiner*—Edgar S. Burr
*Assistant Examiner*—Steven S. Kelley
*Attorney, Agent, or Firm*—Bernard Franzblau

[57] ABSTRACT

A control device for a matrix printer in which the mechanical printing elements of the matrix printer are selectively triggered by the control device a certain time before they reach the desired printing spot on the information carrier in order to compensate for the fact that the printing head will move further over a certain distance between the triggering moment and the moment that the printing element actually hits the information carrier. This distance depends on the speed of the printing element. If the print signal, however, is always generated a constant distance before the printing element reaches the desired printing spot, this signal must be delayed as a function of the speed of the printing element if the printing head is to print accurately also during its run-up and slow-down. To this end, a delay device is provided which delays the print signal for the relevant printing element by a time interval which depends on the printing head speed. A preferred embodiment of the delay device uses a counter, which is also used for determining the energizing time of the magnet and an interval time. Furthermore a correction device for determining the delay time in dependence on the speed is provided. This device works with two adjustable counters, in which one counter counts a constant pulse frequency and the other counter counts position pulses which depend on the movement of the printing element. The constant needle stroke time thus is converted into a speed-dependent path by which the lead distance of the print signal is corrected.

18 Claims, 3 Drawing Sheets

CONTROL DEVICE FOR A MATRIX PRINTER

This is a continuation of application Ser. No. 07/549,344, filed Jul. 6, 1990 now abandoned.

BACKGROUND OF THE INVENTION

This invention relates to a control device for controlling the mechanical printing elements of a matrix printer, which elements are arranged in a printing head moving along the print line and generate the characters to be printed by means of print dots, which dots are arranged in at least one predetermined printing raster, while a control unit generates a print signal for each printing element individually when this printing element reaches a position which lies a certain printing path before an envisaged printing location on an information carrier.

Matrix printers having a number of printing elements arranged in a printing head are generally known in a variety of versions, for example, from DE-PS 26 32 293, which corresponds to U.S. Pat. No. 4,010,835 Mar. 8, 1977. If printing is to take place in exactly defined locations on an information carrier, especially in the case of printing in both directions of movement of the printing head, the mechanical printing element must be triggered already before this location on the information carrier is reached, particularly in order to compensate for the printing time delay between triggering of the printing element, i.e. the printing needle driven by an electromagnet, and its moment of impact on the information carrier. During this needle stroke time the printing head has in fact moved over a certain distance which depends not only on the needle stroke time but also on the printing head speed. The compensation of the needle stroke time, therefore, can be achieved through a fixed lead time.

This is only true, however, if the printing head actually moves with constant speed. During the run-up at the beginning of a print line and the slow-down at the end of a print line (seen in the respective instantaneous direction of movement of the printing head), however, the printing head does not have its programmed speed so that the printing head requires an acceleration range and a deceleration path over which it is not printing. This leads to an increase in the dimensions of the overall matrix printer, and thus in the manufacturing cost, and to a decrease in the printing output.

SUMMARY OF THE INVENTION

The invention has consequently for an object to provide a control device of the kind mentioned in the opening paragraph which makes it possible to print in defined locations on the information carrier even in the case of different speeds of the printing head, especially during the run-up and slow-down at the beginning and end, respectively, of a print line.

According to the invention, this object is achieved in that at least those printing elements whose arrangement in the printing head correspond to a column of the printing raster are connected to a delay device which, upon being controlled by a print signal, starts a control signal for the direct mechanical triggering of the associated printing element after a delay time which is dependent on the speed of the printing head.

The speed-dependent delay in practice results in a path-or or location-dependent shift in the actual control signal for the printing element so that the point of impact of the printing element on the information carrier is practically independent of the printing head speed, thus always at the correct position on the information carrier. The printing head speed can be derived from the scanning of the subsequent positions of the printing head by means of position pulses, for example, from the scanning of a fixedly arranged linear raster by the printing head.

A simple realisation of the delay device according to an embodiment of the invention consists in that the delay device is a counter, that the print signal sets the counter to a correction value which depends on the printing head speed, that the counter then counts to an end value by means of count pulses provided through a count pulse input, and that the control signal is started when this end value is reached. The correction value may be unequivocally determined from the printing head speed and the frequency of the count pulses in conjunction with the end value of the counter.

If, in this embodiment, the printing raster, i.e. the columns in which a dot can be printed, is so narrow that one and the same printing element can only print a text dot after several columns on account of the total movement including return time into the rest position, an individual counter is required for each single printing element in each case.

According to another embodiment of the invention, the delay device is a shift register, the print signal writes a first binary value into a stage of the shift register which is derived from a correction value dependent on the printing head speed, the contents of the shift register are then shifted further by means of shift pulses, and the arrival of the first binary value at a given stage of the shift register starts the control signal. Just as in the case of a counter, in this embodiment the correction value for determining the stage of the shift register into which the first binary value is written can be unequivocally determined from the printing head speed and from the frequency of the count pulses in conjunction with the position of the given stage of the shift register. Only one shift register is required here for all printing elements of the same print column, also in the case of the narrow printing raster referred to above. In either case, the delay can be determined with a high degree of accuracy even for a printing head speed which is not quite constant.

For an even more accurate determination of the delay, especially in the case of an abrupt speed change of the printing head, it is advantageous according to a further embodiment of the invention to derive the count pulses or shift pulses from position pulses generated during the movement of the printing head. The counter or shift register thus performs a count or shift which depends on the path for the delay between the generation of the print signal and the control of the printing element, so that practically a path is measured.

The measures according to the invention always lead to a correct compensation of the needle stroke time of electromagnetically triggered printing needles, even in the case of deceleration or acceleration of the printing head within a print line. This also makes it possible to print in both directions in the graphics mode. Furthermore, the housing width of the printer is reduced and the printing output is increased by the substantial elimination of run-up and slow-down paths.

Advantageously, the generation of the correction value is also derived from these position pulses, especially in the indicated case in which the count pulses or shift pulses are derived from the position pulses. According to a further embodiment of the invention, therefore, a correction device is provided for generating the correction value, which device comprises a first counter with parallel set inputs, which receives at its count input a pulse signal of fixed frequency and at its set inputs a value related to the pulse signal and determined by the printing delay time between triggering of the printing element and its impact on the information carrier, and a second counter with parallel set inputs, which receives at its count input the position pulses and at its two set inputs a value depending on the determined printing path at maximum speed of the printing element, while the two counters receive the same set control signal and a carry signal of the first counter provides a value derived from the position then reached by the second counter to the delay device by way of a correction value.

The basic thought behind this is that the parallel operation of two counters, one of which counts a time, i.e. the printing delay time or the needle stroke time of a printing needle, and the other one counts path-dependent position pulses, results in a conversion of a time into a path, i.e. into that path which the printing head requires at the instantaneous speed in order to reach the printing location on the information carrier, starting from the triggering point of the printing element. Since the print signal, however, is already generated at a position of the printing head which is further away from the desired printing location, in fact by the printing path determined for maximum speed of the printing head, the print signal must be delayed by a path of the printing head which corresponds to the residual content of the second counter. So this counter indicates the correction value. It is obvious that this correction value changes as the printing head speed changes so that, especially during the run-up and slow-down of the printing head, new revised correction values must continuously be determined. In order to generate the correction value as quickly as possible, an embodiment of the invention is characterized in that the set control signal is derived from the carry signal with a delay. In this way a new correction value is determined with practically maximum speed each time, while the delay of the set control signal by the processing speed in the logic circuit used may be chosen correspondingly.

At the maximum printing head speed, an overshoot at the run-up is to be reckoned with in particular and a further safety allowance is advantageously included as well. Nevertheless, it cannot be completely ruled out that in certain conditions, for example, also owing to the occurrence of interference signals, the second counter reaches its end position earlier than does the first counter. In order to prevent the generation of a false correction value in such circumstances, a further embodiment of the invention is characterized in that the appearance of a carry signal of the second counter before the appearance of the carry signal of the first counter generates an error signal. Advantageously, the error signal is derived from the appearance conditions of the two carry signals delayed by at least one pulse period, and the error signal is suppressed when, within the delay time of the error message, another carry signal of the first counter appears. In fact, in this case one may assume that the boundary condition has just been reached, but that no real error is present, so that the correct correction value signal 0 has nevertheless been generated.

A current pulse of an exactly programmed duration must be applied for the control of an electromagnetic printing element, after which a repeated control of the printing element must be prevented for a programmed time duration, so that the element can at least return to its initial position. To determine these times in a simple manner, it is favourable according to a still further embodiment of the invention, when a counter is used, that the counter, after reaching the first end value, switches the count pulse input over to the count pulses of a constant, second frequency corresponding to the energizing time of a printing element, that it ends the first control signal when the end position is reached again, and that it switches over the count pulse input to count pulses with a third frequency, which is so chosen that the counter reaches the end position for a third time in the case of maximum printing head speed after at least a programmed printing element cycle time has elapsed since the print signal, further print signals being blocked up to this moment. In this way it is possible with very little extra effort to generate exactly defined energizing and interval times in addition to the speed-dependent dependent delay. The count pulses of the second and third frequencies can be derived, for example, by division of the pulses of a quartz oscillator. All three frequencies for all delaying devices of the printing elements are the same in that case.

A simple control of the counter is possible according to an embodiment of the invention in that a converter is connected in front of the count pulse input of the counter, which converter supplies the count pulse input successively with a rest signal or count pulses having one of the three frequencies, that the counter generates a carry signal at the end position and starts counting again from the initial position with the next count pulse, and that the carry signal switches a further counting device having four positions, which device controls the converter, generates a load signal for the first counter when a print signal is received, moves into the first operational state, and generates the output signal during the second operational state. The further counting device is of a simple construction in this case since it need have only four positions.

When a shift register is used instead of a counter by way of delaying device, the output of the shift register may be connected to a counter which is controlled with the second and third frequency or with the rest signal, as required, in a way corresponding to the description given above. Such a counter is necessary for each single printing element in the case of the narrow printing raster mentioned above, so that a shift register output simultaneously controls several counters, depending on the data to be printed.

BRIEF DESCRIPTION OF THE DRAWING

Embodiments of the invention will now be described in greater detail below with reference to the accompanying drawing. In the drawing.

DESCRIPTION OF THE PREFERRED EMBODIMENTS

Figure 1:
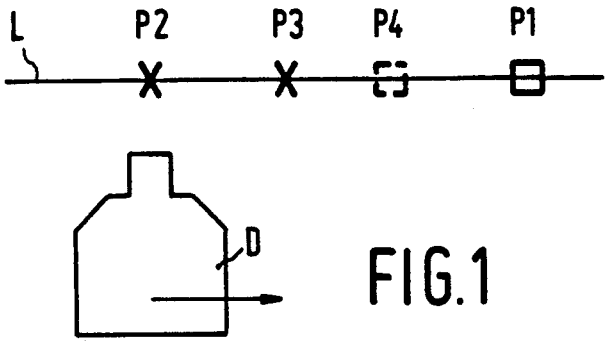
FIG. 1 shows a diagram elucidating the speed-dependent time delay.

In FIG. 1, a printing element D, which is moved in the direction of the arrow shown along the print line L, is present in front of an information carrier merely indicated here as print line L. This printing element D is to print a dot on the print line in the position P1. The printing element D consists more particularly of a magnet, which mechanically activates a printing needle when energized electrically so that this needle hits the print line L. Since the end of the printing needle is at a certain distance from the print line L of the information carrier L before being triggered, a certain time will elapse after triggering of the printing element until the needle hits the information carrier. In order to print the dot P1, the electrical energization of the printing element D must take place before this element has reached the printing position P1, in dependence on the speed with which the printing element D moves. At a given speed, for example the maximum speed, it is assumed that the printing element D is to be energized electrically when it has reached the position P2 on the print line L. This is true for all printing positions at a constant speed, so that the triggering pattern of the printing element D as compared with the printing pattern on the information carrier is shifted as it were by a certain printing path. When printing in the opposite direction of movement of the printing element D, a corresponding shift in the opposite direction is required. This shift can be easily taken into account in the generation of the print signals, as long as the speed of the printing element remains constant. It is advantageous for this purpose to take the speed of the printing element as a starting point which is at least equal to, but for safety reasons greater than the maximum speed of the printing element.

If the printing element moves more slowly, especially at the run-up and slow-down at the start and end, respectively, of the print line L, the electrical energizing of the printing element D for the same printing position P1 must take place at a different position on the print line L. This is because, if the printing element D should be triggered again in position P2, it would only have reached position P4 at the moment the printing needle hits the information carrier after the stroke time of the printing needle at a lower speed in the direction of the arrow. The energizing, and thus the mechanical actuation of the printing element D should accordingly take place with a delay corresponding to the distance between the positions P1 and P4 relative to the print signal generated at P2 for a constant displacement, i.e. at position P3, if printing is to take place at position P1 again. This means that the print signal must also be delayed by the path between P2 and P3. This is the path remaining of the path between P1 and P2 after the path travelled by the printing element along the print line during the needle stroke time has been subtracted from it. So a delay between the print signal and the triggering signal of the printing element must be provided, the delay time depending on the speed of the printing element.

Figure 2:
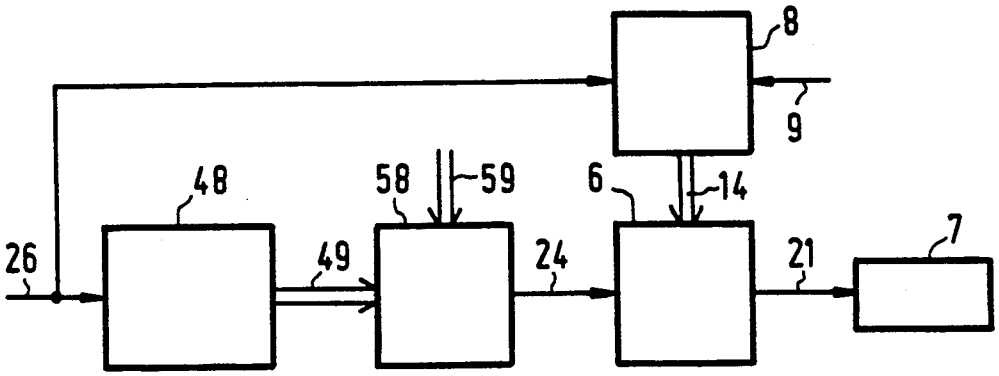
FIG. 2 shows a block diagram of a device for generating the trigger signals for a printing element.

In FIG. 2, the diagram shows a device for controlling an electromechanical printing element of a matrix printer in which a speed-dependent delay is provided between the print signal and the energizing signal for the printing element. Position pulses are fed to input 26, which pulses are derived from the movement of the printing element D, the distance between two position pulses accordingly corresponding to a given path of the printing element D. These position pulses are supplied to a device 48 which preferably adds together these position pulses so that a value appears at output 49 which indicates the position of the printing element. This value is supplied to a comparator 58, which receives a required position of the printing element via a further input 59. This position may be, for example, position P2 in FIG. 1. The moment that the printing element D has reached this position, the comparator 58 provides a print signal at output 24. It is assumed in this case that only those positions where printing is actually to take place are supplied to input 59. It is also possible, however, to supply positions of a printing raster to the input 59 in which a printing point is possible, but depending on the information to be printed, which may be, for example, stored in a memory, picture point by picture point, the print signal 24 then being supplied to this memory.

In the case where a dot is actually to be printed, therefore, a print signal is supplied to a delay device 6 via the line 24. In response to a print signal, the delay device 6 provides a control signal to the printing magnets 7 via the line 21 after a delay time which is determined from a correction value supplied via the connection 14 of a correction device 8, upon which the magnet immediately puts the printing needle into action.

Only one printing element has been mentioned until now, but a matrix printer generally comprises a larger number of printing elements in a printing head. When the positions of a printing raster are supplied via the input 59, the devices 48 and 58 and the correction device 8 for generating the correction value on the connection 14 may be shared by all printing elements of the printing head.

The correction value on the connection 14 is generated by the correction device from the position pulses on the line 26 and from a pulse signal of constant frequency on a line 9, as well as from further fixedly set parameters.

Figure 3:
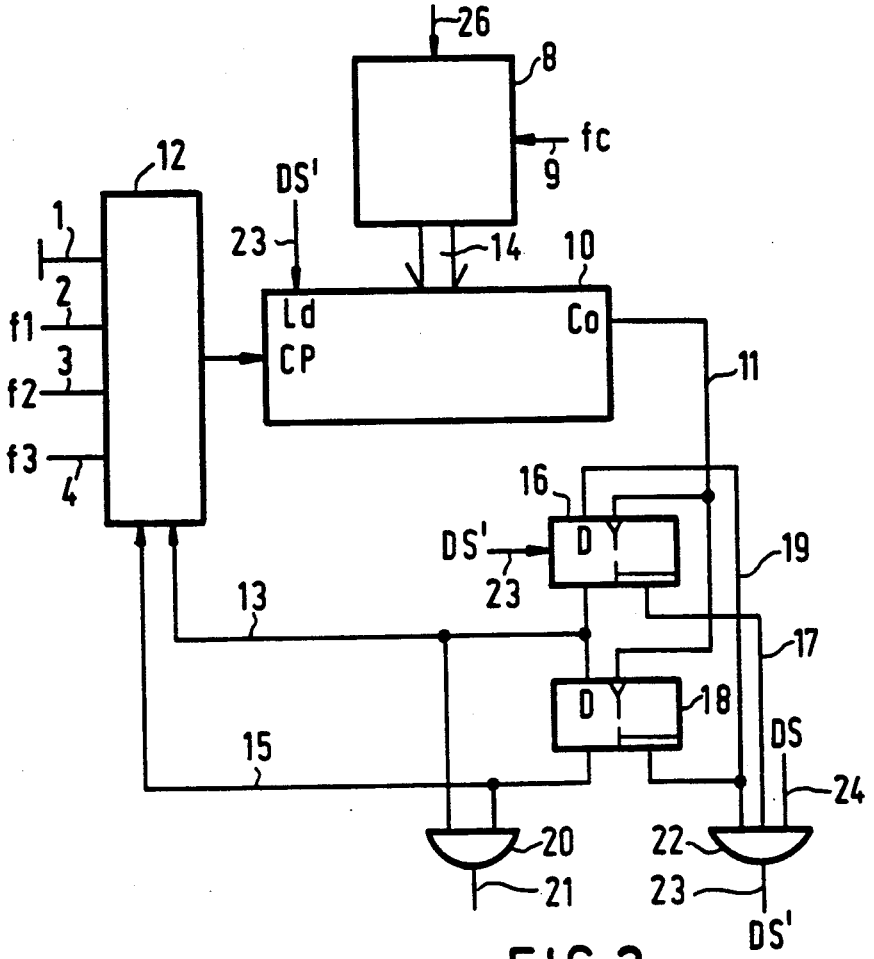
FIG. 3 shows a block diagram of a control device according to the invention comprising a counter.

The control device shown in FIG. 3 represents an embodiment of the delay device 6 which is in fact present several times, i.e. once for every printing element. It comprises a counter 10, and each counter serves both to delay the print signal in dependence on the printing head speed and to determine the energizing time or actuation time of the printing element(s) and to determine the ensuing interval time. For this purpose, the counter can be set to the correction value K by the signal DS', this correction value being supplied by the correction device 8 via the multiple connection 14. This DS' signal is generated from the print signal DS coming from the exterior through line 24 and via the AND gate 22 when this gate is released through the signals in lines 17 and 19 supplied by D-flipflops 16 and 18 in their rest states.

The counter 10 receives count pulses f1, f2 and f3 from a converter device 12 which may conveniently be designed as a 4:1 multiplexer and which is controlled by the operational outputs of the D-flipflops 16 and 18 via the lines 13 and 15. In the rest state of these flipflops the input 1, which receives a rest signal, is connected through the converter to the count input of counter 10, so that the counter 10 does not count.

The moment a print signal DS is received on line 24, a signal DS' appears on line 23, setting the counter 10 to the correction value K, as explained above, and also bringing the D-flipflop 16 into the operational state. Thus on the one hand the AND gate 22 is blocked through line 17 and on the other hand the conversion device 12 is switched to the next position, in which the counter 10 receives and counts the pulse signal supplied through input 2 with a path-dependent frequency f1, which signal, like the signal on line 26, for example, is derived from scanning of the printing head position. The counter 10 now counts this pulse signal until it has reached its end position and supplies a carry signal at the carry output through line 11, which signal is supplied to the pulse inputs of the D-flipflops 16 and 18. This also switches the D-flipflop 18 into the operational state, while the D-flipflop 16 remains in this state.

Since both D-flipflops 16 and 18 are now operational, the AND gate 20 generates a release signal for energizing the magnets of the corresponding printing elements at output 21, while in addition the conversion device 12 supplies the pulse signal coming in through input 3 to the counter 10. This pulse signal has a fixed frequency f2 of such a value that the counter 10 reaches the end position, in which another carry signal is generated on the line 11, in that time interval during which the magnets must remain energized after the generation of the carry signal, starting from the initial position. It should be noted that it is also possible for the counter to start from the end position and count back down to the initial position if this should be technologically preferable.

Figure 4:
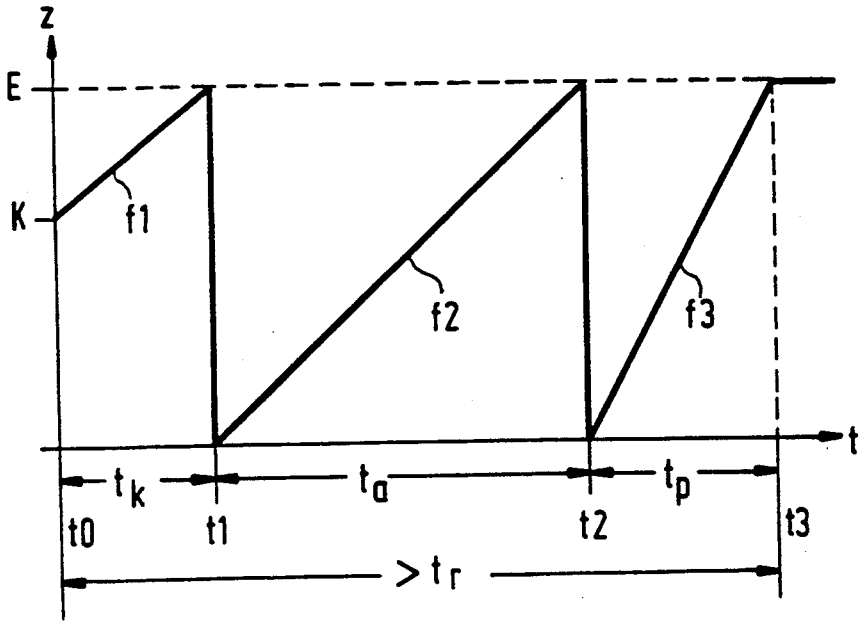
FIG. 4 shows a time diagram of counter positions of the said counter.

This time schedule of the counter positions is shown in more detail in FIG. 4. At moment t0, the print signal DS has appeared so that the counter position is set to the correction value K, after which the counter counts further at the frequency f1 derived from the printing head speed until the end position E is reached. During this period the compensation time interval $t_k$ elapses, which, as mentioned above, represents a time which depends on the path travelled by the printing head.

At the moment t1 the counter has reached the end position E and restarts counting, but this time at the frequency f2 of the signal supplied to the input 3 of the converter 12 in FIG. 3.

When time interval $t_a$, corresponding to the energizing time of the printing magnets, has elapsed, the counter reaches the end position E for a second time, i.e. at the moment t2, and again a carry signal appears on line 11 in FIG. 3, switching the D-flipflop 16 to the rest position since a logic "0" is present on line 19 because of the operational state of the D-flipflop 18. The D-flipflop 18 remains in the operational state. Thus ends the signal generated by the AND gate 20 at output 21, while in addition the converter 12 is switched further, so that the counter 10 receives the pulse signal with frequency f3 supplied at input 4. This frequency determines the interval time $t_p$ up to the moment t3, which is of such a value that the sum of all time intervals $t_k$, $t_a$ and $t_p$ is greater than the operational cycle time $t_r$ of the printing elements.

When the counter 10 has regained its end position E at the moment t3, it again generates a carry signal on line 11 which switches the D-flipflop 18 into the rest state, while the D-flipflop 16 is and remains in this rest state. This again releases the AND gate 22 for generating at the next printing signal DS the signal DS' on line 23. Any printing signal occurring earlier is suppressed, i.e. it does not lead to triggering of the printing elements. Such a suppressed printing signal can indeed only occur when owing to an extreme operating condition, for example, in very narrow printing, more dots are to be printed than can be optically resolved in observing the printed character.

With both D-flipflops 16 and 18 back in the rest state, the converter 12 is in its turn switched over again so that the counter 10 receives the rest signal at input 1 and remains preferably in the end position, as is represented in FIG. 4.

In this way, a single counter not only determines the energizing time of the printing magnets, but also determines and at the same time monitors the correct triggering point of the printing magnets, so that the maximum operating frequency of the printing elements is not exceeded. The D-flipflops 16 and 18 represent a counter with four positions, which, however, may also be realised in various alternative ways.

The arrangement described is required at least for each group of printing needles coinciding with the printing raster. Alternatively, however, it is possible to provide such an arrangement for each printing element, the print signal supplied through line 24 being directly assigned to a particular printing element whose printing magnet is individually controlled through line 21.

Figure 5:
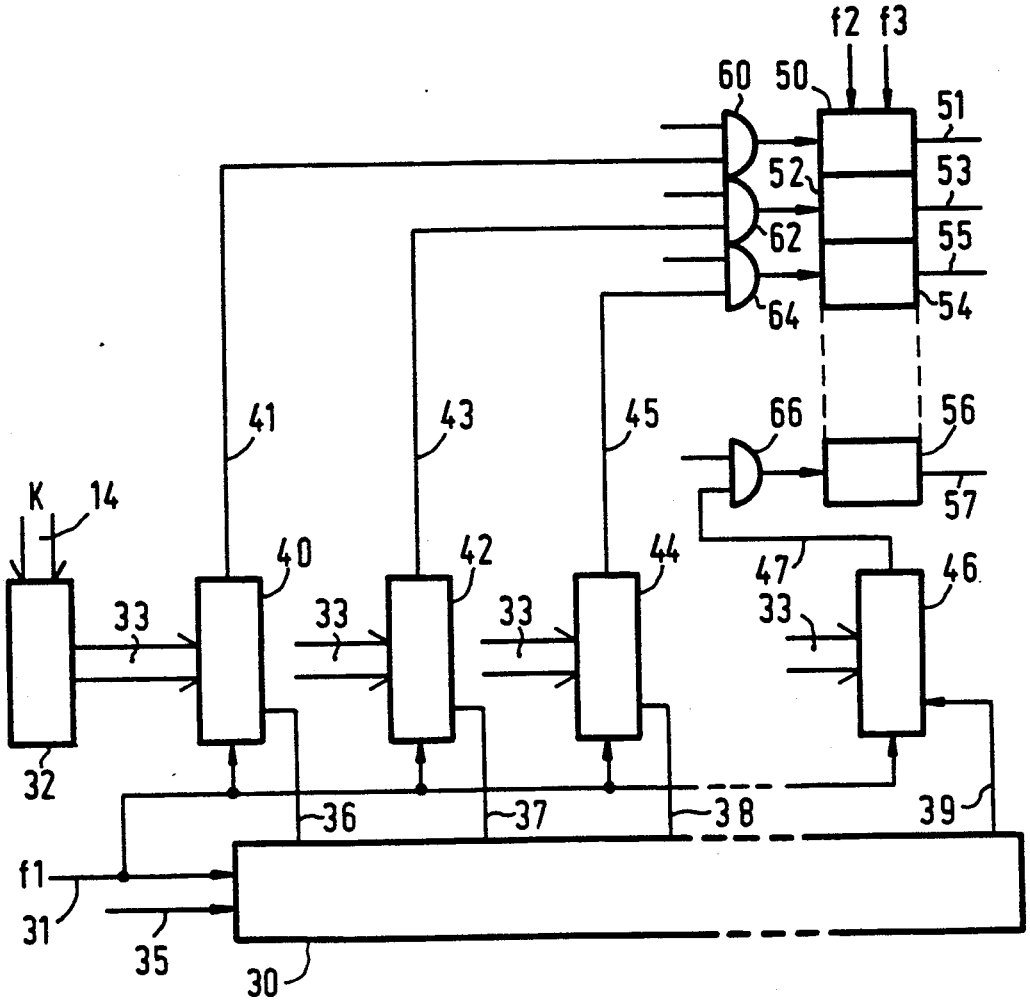
FIG. 5 shows a block diagram of a control device according to the invention comprising shift registers.

An alternative control device, in which the delay of the printing signals is provided by shift registers, is shown in FIG. 5. Here a delay device 30 is present which generates the printing signals, whose timing depends on the arrangement of the printing elements in the printing head, at the outputs 36 to 39, as is described in the previous, non pre-published Patent Application P 39 07 080.8 which corresponds to U.S. Pat. No. 5,048,984. These delayed printing signals are derived from a signal supplied through line 35, which signal depends on the density of the printing raster and which is shifted further through the device 30 by a pulse signal on line 31, the frequency f1 of this pulse signal being derived again from the printing head position pulses.

The correction value K is generated in a way corresponding to that indicated in FIG. 3 and is supplied in coded form through the multiple connection 14 to a decoder 32, which converts this correction value K to a one-to-n representation on multiple line 33. This multiple line 33 is coupled to parallel set inputs of a number of shift registers 40, 42, 44 to 46, the load inputs of which registers are each connected to one of the outputs 36–39 of the device 30 and write the instantaneous decoded correction value into the relevant shift register upon a signal at an output. This means that a certain level in the shift register is set for a first binary value, for example logic "1", while at least a number of previous stages contain the other binary value. This logic value "1" is subsequently shifted further along at the pulse signal with frequency f1 on line 31, until it arrives at the end of the shift register.

The outputs 41, 43, 45 and 47 of the shift registers 40, 42, 44 and 46 each supply an AND gate 60, 62, 64 and 66, respectively, which gates receive, possibly delayed, signals from a character generator at the other gate inputs, which is not further indicated in the drawing. The outputs of the AND gates control counter devices 50, 52, 54 and 56, which may be constructed in the same way as the circuit represented in FIG. 3, but which in this case alternately are either in the rest state or are counted further with pulse signals at the frequencies f2 or f3, as applicable. The outputs 51, 53, 55 and 57 of the counter devices then control, for example, the electromagnets of printing needles. Thus, the counter devices 50, 52, 54 and 56 determine the energizing times of the electromagnets and the ensuing interval times, while the shift registers 40, 42, 44 and 46 generate the delay of the printing signals appearing at the outputs 36 to 39 of the device 30 in dependence on the printing head speed. The instantaneous printing head speed during this operation is incorporated both in the correction value K supplied through connection 14 and in the frequency f1 of the pulse signal on line 31.

Figure 6:
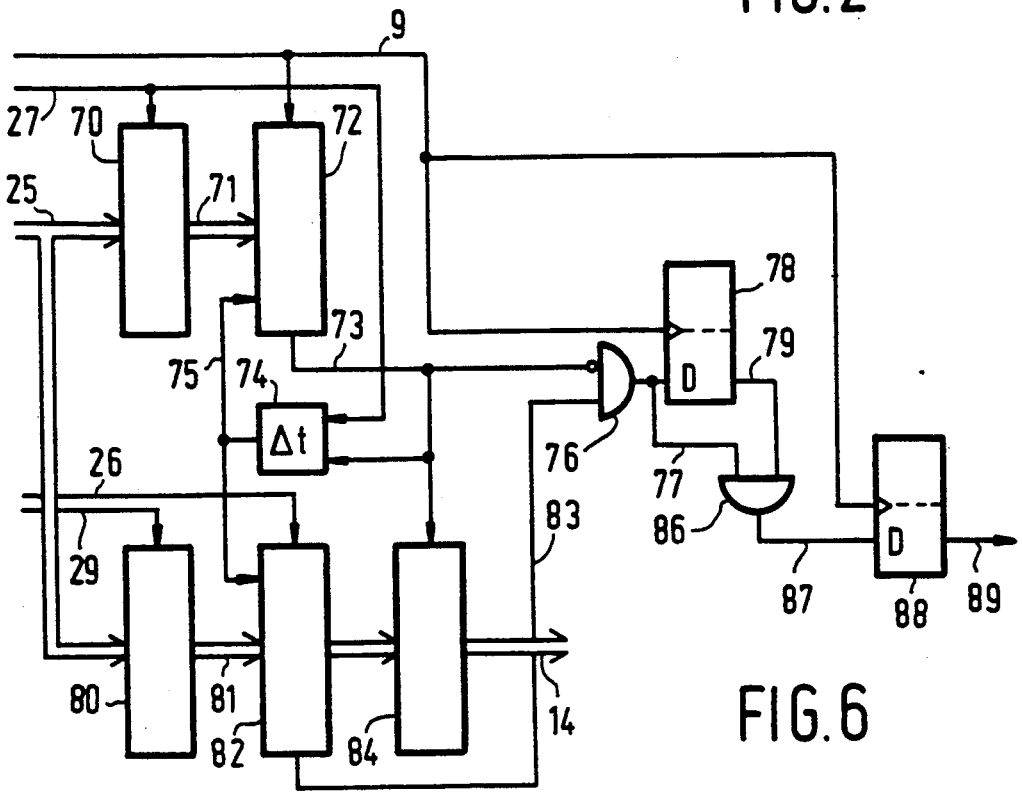
FIG. 6 shows the block diagram of an embodiment of a correction device for use in the invention.

The circuitry of the correction device 8 for the generation of the correction value K is shown in more detail in FIG. 6. It comprises two registers 70 and 80, each for a data word having a number of bits, to each of which registers a data word is supplied in parallel via an input 25, the data word being written into the register 70 by means of a write signal on the line 27 and into the register 80 via a write signal on the line 29.

The output of the register 70 is connected to the parallel set inputs 71 of a counter 72, which receives pulse signals of a constant frequency via the line 9 at its count input. A value has been written into the register 70 here which corresponds to the needle stroke time of the printing needle of a printing element in relation to the pulse signals on the line 9, i.e. when the counter 72 is set to this value by a set control signal on the line 75, it will exactly reach its end position during the total needle stroke time and generate a carry signal at the output 73.

The output of the register 80 is connected to set inputs 81 of a counter 82, which receives position pulses supplied via the line 26 at its count input. The value written into the register 80 corresponds to the path of the printing element during the needle stroke time at maximum speed of the printing element, i.e. in the case of FIG. 1 the number of position pulses during the movement of the printing element D from position P2 to printing position P1. If, with the set control signal on the line 75, both counters 72 and 82 are simultaneously set to their respective positions, the counter 82 will exactly reach its end position when the counter 72 reaches its end position and supplies a carry signal on the line 73 at maximum printing element speed, i.e. in the case of the highest frequency of the position pulses on the line 26. However, if the printing element moves more slowly, fewer position pulses will appear on the line 26 up to the moment the carry signal appears on the line 73, so that the counter 82 will not yet have reached its end position then. The position then reached, or more precisely the difference with the end position, gives the delay time, more particularly the number of position pulses by which the control signal on the line 21 in FIG. 2 is to be delayed by the delay device 6 relative to the print signal on the input line 24 of the delay device. The complement of this counter position is written into a register 84 via the carry signal on the line 73, the correct correction value then appearing at the output 14 of this register.

The carry signal on the line 73 further controls a delay member 74 which generates the set control signal on the line 75. The delay member 74 serves first and foremost to safeguard the correct transfer of the counter position of the counter 82 to the register 84 before the counter 82 is again set by the set control signal on the line 75. The write signal on the line 27 also controls the delay member 74 in order to start the determination of the correction value. If equivalent components or circuit technology are used, the delay member 74 may also be omitted.

The register 84 may alternatively be provided as part of the delay device 6. A transfer of the counter position of the counter 82 at the appearance of the carry signal 73 may also take place in that the counter 82 then receives further count signals, in this case advantageously from a pulse source of a constant, high frequency, until it reaches its end position and generates a carry signal, in which case only these additional pulse signals are transferred to the delay device 6 and switch a counter there. This leads to a less costly wiring system, but the correction value is not updated so frequently in this case.

If all parts function correctly, a carry signal cannot appear on the line 83 in the circuit of FIG. 6 before the counter 72 has generated a carry signal on the line 73. If a faulty condition, however, for example, interference pulses, nevertheless causes the counter 82 to reach its end position first, there is an error which will lead to a false correction value. In order to recognise this error, an AND gate 76 is provided which produces a signal on the output line 77 if the carry signal appears on the line 83 before a carry signal has appeared at the line 73. The output 77 is connected to the D input of a D flipflop 78 which takes the signal on the line 77 at the next pulse signal on the line 9 and supplies it at output 79. This can already be recognized as an error signal.

However, to prevent unnecessary error messages in marginal situations, i.e. in which both counters 72 and 82 have reached their end positions practically simultaneously, counter 82 being ahead by not more than one pulse period, a delay of the error signal is incorporated by means of an AND gate 86 and a D flipflop 88. Only in the case when the D flipflop 78 is set and the error condition is still obtained will the AND gate 86 be released by the relevant signals on the lines 77 and 79. The output of the AND gate 86 controls the D input of the flipflop 88, while the flipflop 88 is set at the next pulse on the line 9 and supplies an error signal at an output 89. If on the other hand the counter 72 has also reached its end position at the next pulse signal on the line 9 after the counter 82 has reached its end position, the flipflop 78 is set, it is true, but the signal at output 77 of the AND gate 76 disappears after that so that the flipflop 88 is then not set anymore. The result obviously is the correct correction value zero at output 14.

The use of the registers 70 and 80 implies that the programmed values for the counters 72 and 82 can be easily modified. If, for example, the maximum printing head speed is reduced, as might be the case for printing in a particularly narrow printing raster for a high printing quality, the value in register 80 may be correspondingly reduced, in which case the distance or shift of the print signals relative to the corresponding dots to be printed must also be chosen to be smaller. The value written into the register 70 is, for example, reduced when a thicker set of papers is to be printed instead of a single sheet, since the needle stroke time is shorter in that case. By reducing is meant in this case that the counters 72 and 82 then require a smaller number of pulses at the count input in order to reach the end position, for which the counters at the set inputs 71 and 81 receive, for example, the complementary values of the values written into the registers 70 and 80, respectively.

Obviously, alternative technical realization possibilities exist for the delay of the printing signals in dependence on the printing head speed, for example, by the use of analog-controllable delay elements.

We claim:

1. A control device for selectively controlling the mechanical printing elements of a matrix printer, which elements are arranged in a printing head moving along a print line to generate the characters to be printed by means of print dots, which dots are arranged in at least one predetermined printing raster, said control device comprising:

a control unit which generates a print signal for each printing element individually when said printing element reaches a position which lies a certain printing path before an envisaged printing location on an information carrier, characterized in that at least those printing elements whose arrangement in the printing head corresponds to a column of the printing raster are connected to a delay device which is controlled by the print signal to start a control signal for the direct mechanical triggering of the associated printing element after a delay time which is dependent on the speed of the printing head, wherein the delay device comprises a shift register and the print signal writes a first binary value into a stage of the shift register and which is derived from a correction value dependent on the printing head speed, the contents of the shift register are then shifted further by means of shift pulses and the arrival of the first binary value at a given stage in the shift register starts the control signal, and wherein the shift pulses are derived from position pulses generated during the movement of the printing head and the delay time is independent of which printing element is selected.

2. A control device as claimed in claim 1, further comprising a correction device for generating the correction value, which correction device comprises, a first counter with parallel set inputs which receives at its count input a pulse signal of constant frequency and at its set inputs a value related to the pulse signal and determined by the printing delay time between triggering of the printing element and its impact on the information carrier, and a second counter with parallel set inputs which receives at its count input the position pulses and at its set inputs a value depending on the determined printing path at maximum speed of the printing element, wherein the two counters receive a same set control signal, and wherein a carry signal of the first counter is operative as a control signal so that a correction value, derived from the position then reached by the second counter, is supplied to the delay device.

3. A control device as claimed in claim 2, further comprising means for generating an error signal upon the appearance of a carry signal of the second counter before the appearance of the carry signal of the first counter.

4. A control device as claimed in claim 3, wherein said error generating means derives the error signal if the carry signal of the first counter appears with a delay of at least one period of the pulse signal after the appearance of the carry signal of the second counter.

5. A control device for selectively controlling the mechanical printing elements of a matrix printer, which elements are arranged in a printing head moving along a print line to generate the characters to be printed by means of print dots, which dots are arranged in at least one predetermined printing raster, said control device comprising:

a control unit which generates a print signal for each printing element individually when said printing element reaches a position which lies a certain printing path before an envisaged printing location on an information carrier, characterized in that at least those printing elements whose arrangement in the printing head corresponds to a column of the printing raster are connected to a delay device which is controlled by the print signal to start a control signal for the direct mechanical triggering of the associated printing element after a delay time which is dependent on the speed of the printing head, and wherein the delay device comprises a counter and the print signal sets the counter to a correction value which depends on the printing head speed and the counter then counts to a first end value by means of count pulses of a first frequency provided via a count pulse input, whereby the control signal is started when said first end value is reached.

6. A control device as claimed in claim 5, further comprising switching means controlled by the counter so that the counter, after reaching the first end value, controls the switching means to switch the count pulse input to count pulses of a constant, second frequency corresponding to the energizing time of a printing element, wherein the switching means ends the control signal when the counter end value is reached a second time and also switches over the count pulse input to count pulses having a third frequency chosen so that the counter reaches the end value for a third time for a maximum printing head speed after at least a programmed printing element cycle time has elapsed since the print signal, further print signals being blocked up to that moment.

7. A control device as claimed in claim 6, wherein the switching means further comprises a converter connected to the count pulse input of the counter, which converter supplies the count pulse input successively with a rest signal and count pulses of the three frequencies, wherein the counter generates a carry signal in its end position and starts counting again from an initial position with the next count pulse, and the carry signal switches a further counting device having four positions, which device controls the converter, generates a load signal for the first counter when a print signal is received, moves into the first operational state, and generates the output signal during the second operational state.

8. A control device as claimed in claim 5, wherein the count pulses are derived from position pulses generated in response to movement of the printing head.

9. A control device as claimed in claim 8, further comprising a correction device for generating the correction value, said correction device comprising; a first counter with a set of parallel inputs and a count input which receives a pulse signal of constant frequency, said set of inputs receiving a value related to the pulse signal and determined by the printing delay time between triggering of the printing element and its impact on the information carrier, and a second counter with a set of parallel inputs which receives at its count input the position pulses and at its set of parallel inputs a value depending on the determined printing path at maximum speed of the printing element, wherein the two counters receive a same set control signal, and wherein a carry signal of the first counter operates as a control signal so that a correction value, derived from the position then reached by the second counter, is supplied to the delay device.

10. A control device as claimed in claim 9, further comprising means for generating an error signal upon the appearance of a carry signal of the second counter before the appearance of the carry signal of the first counter.

11. A control device as claimed in claim 10, wherein said error generating means derives the error signal if the carry signal of the first counter appears with a delay of at least one period of the pulse signal after the appearance of the carry signal of the second counter.

12. A control device for controlling operation of the mechanical printing elements arranged in a printing head of a matrix printer, said control device comprising:

a first input for receiving signal pulses indicative of the speed of the printing head and generated in response to movement of the printing head, means responsive at least to said signal pulses for deriving a print signal at a predetermined distance before the printing elements reach a desired printing spot on an information carrier, a correction device responsive to said signal pulses and to a pulse signal of constant frequency to derive at its output a correction signal determined by the speed of the printing head, and a delay device responsive to said print signal and to said correction signal for deriving at its output a control signal for triggering the printing elements after a delay time determined by the correction signal and thus by the speed of the printing head.

13. A control device as claimed in claim 12 wherein the delay device comprises;

a counter having first input means for receiving said correction signal and which, under control of the print signal, sets the counter to a correction count determined by the speed of the printing head, said counter having a count pulse input and an output, and means for applying count pulses of a first frequency to said count pulse input whereby the counter counts to a first end count position at which it delivers a signal at its output whereby said control signal is started.

14. A control device as claimed in claim 13 wherein the delay device further comprises;

a logic circuit controlled by the signal at the counter output, and said count pulse applying means comprises a switching device having input means coupled to terminals for supplying count pulses of said first frequency and of a second frequency corresponding to the energizing time of a printing element and of a third frequency related to the cycle time of the control device, and means coupling output means of the logic circuit to a control input of the switching device whereby, when the counter reaches said first end count position, the switching device in response to the logic circuit supplies count pulses of the second frequency to the counter count input whereby the counter counts to the end count position a second time to trigger the switching device via the logic circuit to supply the counter count pulse input with count pulses of the third frequency.

15. A control device as claimed in claim 12 wherein the correction device comprises;

a first counter having a count input for receiving a constant frequency pulse signal and input means for receiving a signal related to the pulse signal and determined by the printing delay time, said first counter also having a further input and a carry signal output, a second counter having a count input which receives the signal pulses and having input means for receiving a signal dependent on a determined printing path for maximum speed of the printing elements, said second counter also having a further input and an output for developing the correction signal, and a delay device coupling the carry signal output of the first counter to said further inputs of the first and second counters.

16. A control device as claimed in claim 15 wherein the correction device further comprises;

a logic circuit controlled by said carry signal output, by a carry signal output of the second counter, and by said constant frequency pulse signal thereby to derive an error signal if the second counter produces a carry signal before the first counter produces its carry signal.

17. A control device as claimed in claim 12 wherein the delay device comprises;

a shift register having input means for receiving said correction signal and further input means for the print signal whereby a first binary value is written into a stage of the shift register which is determined by said correction signal, the contents of the shift register being shifted by shift pulses so that when said first binary value reaches a given stage of the shift register the shift register develops a signal to start the control signal.

18. A control device as claimed in claim 17 wherein said shift pulses are derived from the signal pulses.

* * * * *